US008210997B2

(12) United States Patent
Thomas et al.

(10) Patent No.: US 8,210,997 B2
(45) Date of Patent: Jul. 3, 2012

(54) EXERCISE DEVICE

(76) Inventors: Amelia N. Thomas, Nokomis, FL (US); Janine M Alexander, Oviedo, FL (US)

( * ) Notice: Subject to any disclaimer, the term of this patent is extended or adjusted under 35 U.S.C. 154(b) by 0 days.

(21) Appl. No.: 12/692,995

(22) Filed: Jan. 25, 2010

(65) Prior Publication Data

US 2010/0204020 A1 Aug. 12, 2010

Related U.S. Application Data

(60) Provisional application No. 61/207,137, filed on Feb. 9, 2009.

(51) Int. Cl.
*A63B 21/00* (2006.01)

(52) U.S. Cl. ..... 482/117; 482/115

(58) Field of Classification Search ..... 482/106–108, 482/115, 114, 109, 117; 135/65, 77, 78, 135/85; 180/218, 6.5, 8.5
See application file for complete search history.

(56) References Cited

U.S. PATENT DOCUMENTS

| | | | | | |
|---|---|---|---|---|---|
| 788,541 | A * | 5/1905 | Kunkel | 135/65 |
| 2,445,942 | A * | 7/1948 | Dusinberre | 135/85 |
| 2,590,052 | A * | 3/1952 | Patterson | 135/85 |
| 2,802,479 | A * | 8/1957 | Hickman | 135/65 |
| 3,223,099 | A * | 12/1965 | Hagood, Sr. | 135/85 |
| 4,018,440 | A * | 4/1977 | Deutsch | 482/68 |
| 4,621,804 | A * | 11/1986 | Mueller | 280/87.041 |
| 5,039,091 | A | 8/1991 | Johnson | |
| 5,390,687 | A * | 2/1995 | Tsai | 135/65 |
| 5,478,283 | A | 12/1995 | Hoblit | |
| 5,938,240 | A * | 8/1999 | Gairdner | 280/826 |
| 7,244,201 | B2 | 7/2007 | Hale | |
| 7,326,155 | B2 | 2/2008 | Kim | |
| 7,866,430 | B2 * | 1/2011 | Kakinuma et al. | 180/218 |
| 2009/0194960 | A1 * | 8/2009 | Peterson | 280/87.041 |
| 2009/0280965 | A1 | 11/2009 | Shapiro et al. | |

* cited by examiner

*Primary Examiner* — Jerome W Donnelly
(74) *Attorney, Agent, or Firm* — Richard H. Thomas

(57) ABSTRACT

The present invention resides in an exercise device that is lightweight and easy to transport, and is particularly effective in improving neuromuscular/proprioceptive coordination, balance and core strength. The exercise device draws on the well known physical fitness benefits of canoe and kayak paddling, and at the same time is a device that can be used in a gym, home, office, or at any land site desired. The exercise device of the present invention comprises a pole that can be grasped in two hands similar to grasping a canoe or kayak paddle. A yoke is positioned at one end of the pole. A roller is held axially in the yoke. A variable resistance brake controls the ease with which the roller is able to rotate within the yoke. An adjustment means may be positioned on the pole that allows the user of the device to control the variable resistance.

11 Claims, 3 Drawing Sheets

EXERCISE DEVICE

RELATED APPLICATIONS

This application claims the benefit of U.S. Provisional Application Ser. No. 61/207,137 filed Feb. 9, 2009. The benefit of the filing date of the Provisional Application is hereby claimed. The disclosure on the aforementioned Provisional Application is hereby incorporated herein in its entirety by reference hereto.

BACKGROUND OF THE INVENTION

1. Technical Field

The present invention relates to a new and improved exercise device and particularly to an exercise device that simulates paddling a canoe or kayak and provides the benefits thereof.

2. Brief Description of the Prior Art

U.S. Pat. No. 5,039,091 discloses an exercise machine that has a flywheel with variable resistance. In FIGS. 31 and 32, the patent discloses a user seated in the machine executing the beginning of a canoe paddling stroke employing a part of the machine components. The machine resembles a "Nautilus" machine in some respects in that it is relatively large and capable of multiple exercises.

U.S. Pat. No. 7,244,201 discloses a game stick for playing with a spherical ball. The game stick has a handle and, at the opposite end, a toroidal body having a downwardly facing cup-shaped frusto-spherical depression allowing a player to propel and control a ball.

U.S. Pat. No. 5,478,283 discloses a bowling ball propulsion device including a handle and a frame at one end of the handle. The frame comprises a rear member for pushing the bowling ball and two side members spaced far enough apart to embrace the bowling ball.

U.S. Pat. No. 7,326,152 discloses a golf swing-type exercise device that has an adjustable shaft and an offset extension that allows a resistance means to apply a torque force to the handle shaft as the swing approaches a hitting region.

BRIEF DESCRIPTION OF THE PRESENT INVENTION

The present invention resides in an exercise device that is lightweight and easy to transport, and is particularly effective in improving neuromuscular/proprioceptive coordination, balance and core strength. The exercise device draws on the well known physical fitness benefits of canoe and kayak paddling, and at the same time is a device that can be used in a gym, home, office, or at any land site desired.

More specifically, the exercise device of the present invention comprises a pole that can be grasped in two hands similar to grasping a canoe or kayak paddle. A yoke is positioned at one end of the pole. A roller is held axially in the yoke. A variable resistance brake controls the ease with which the roller is able to rotate within the yoke. An adjustment means is positioned on the pole that allows the user of the device to control the variable resistance.

The exercise device can be extendable, for instance by means of telescoping sections. Examples of suitable rollers are a spherical ball or a wheel. The diameter of the ball or wheel can be slightly larger than that of a tennis ball. The ball or wheel can rotate on an axle held by the yoke In one embodiment of the present invention, the exercise device comprises a grip at the end of the pole opposite the yoke end to simulate a conventional canoe paddle handle. The pole is oriented with respect to the yoke so that it lies in a plane parallel to that of the yoke.

BRIEF DESCRIPTION OF THE DRAWINGS

The invention and advantages thereof will become more apparent from the following detailed description of the invention with reference to the accompanying drawings, in which.

DETAILED DESCRIPTION OF THE PRESENT INVENTION

Figure 1:
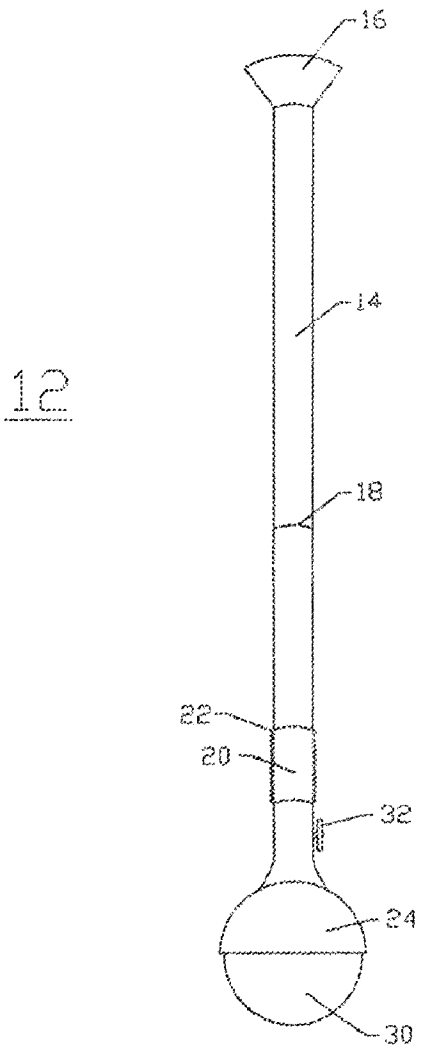
FIG. 1 is an elevation front view of the exercise device in accordance with an embodiment of the present invention.

Referring to FIG. 1, an exercise device 12 in accordance with one embodiment of the present invention is shown. The exercise device 12 comprises an elongated pole 14 having at its upper end a handle or grip 16 that resembles a conventional canoe paddle grip or handle. The grip 16 can have a variety of configurations depending upon personal preferences, but the grip is usually configured in some manner to make it comfortable for a user to grasp it in one hand, and at the same time orient the pole 14 rotation-wise. In the case of a conventional canoe paddle, the pole is oriented so that the flat blade of the paddle is generally at right angles to the motion of the paddle. An object of the grip 16 in the embodiment of FIG. 1 is similarly to orient the pole 14, as will be described.

The exercise device 12 comprises an extension means 18 that is only shown schematically. It can comprise any of a number of commercially known extension devices, for instance telescoping sections that allow the pole 14 to be lengthened or shortened as desired. Below the extension means 18, the device 12 comprises a shock absorption means 20. The purpose of the shock absorption means 20 is to absorb shock during use of the exercise device 12. In the embodiment shown in FIG. 1, the shock absorption means 20 comprises an external rubber covering 22 (FIG. 2) and an internal conventional metal coil spring (not shown). The shock absorption means 20 can, however, be from other fields of technology, for instance hydraulic, pneumatic, or electrical. The locations of the respective components can be other than as shown in FIG. 1. The strength of the shock absorption means can be generally that which reduces shock to that experienced when dipping a paddle into water. If desired, the shock absorption means 20 can be made adjustable to vary the amount of shock absorbed; that is to make the device of the present invention more or less rigid.

Figure 2:
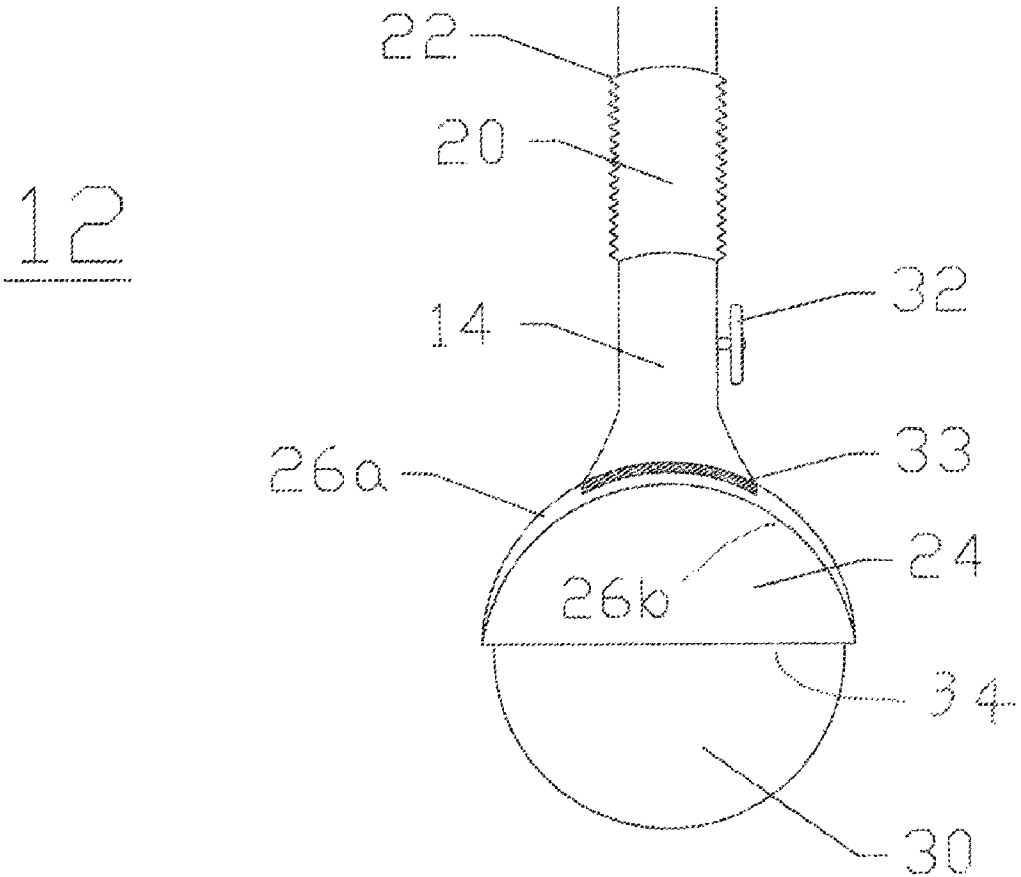
FIG. 2 is an enlarged front view of the lower end of the exercise device of FIG. 1 showing details of the device.

At the lower end of the pole 14, the exercise device 12 comprises a yoke 24, FIG. 2. The yoke 24 comprises arms 26*a* and 26*b* (see FIGS. 2 and 3) that extend outwardly to provide a yoke configuration. An axle 28, FIG. 3, extends between the lower ends of the arms 26*a* and 26*b*. The yoke 24 is mounted on the pole 14 so that the yoke arms 26*a* and 26*b* lie in a plane that is generally parallel to the plane of the handle grip 16, as is evident from FIGS. 1 and 2. In this embodiment of the present invention, a ball 30 is mounted on the axle 28. It is sized to fit within the embrace of the yoke 24 and to freely rotate on the axle 28. The pole 14 comprises a resistance knob 32. Referring to FIG. 2, a resistance pad 33 is positioned between the yoke 24 and the ball 30. The resistance pad 33 is mounted on a rod (not shown) that extends upwardly into the pole 14 and is actuated axially up or down within the pole by the resistance knob 32. Other actuating means can be used as well. The pad 33 functions as a brake. With rotation of the resistance knob 32, the user of the exercise device 12 can control the resistance to rotation of the ball 30. Knob 32 is turned with resistance so that it remains at whatever point is set by the user of the device.

In operation, the user of the exercise device of FIG. 1 grasps the grip 16 with one hand and the lower end of the pole 14 with the other hand similar to grabbing a canoe paddle, and then executes a stroke similar to a canoe stroke. In the stroke, the user brings the pole 14 down and rearward in a swinging motion that causes the ball 30 to engage a surface, such as a wooden floor, and then roll along the surface, causing the ball to rotate. By adjustment of the resistance knob 32, the resistance to rotation is controlled. At the end of the stroke, the exercise device 12 is raised to disengage the ball from the surface, and the device 12 is brought back to its starting position, allowing the stroke to be repeated; similar to paddling a canoe. By adjusting the resistance to rotation, plus the amount of time the device is used, and the rapidity of the stroke, the user can adjust the intensity and magnitude of a workout.

Instead of resembling canoe paddling, the exercise device of the present invention can be adapted to provide an exercise resembling that of paddling a kayak. In this example, the device is similar to that of FIG. 1, except that the yoke is oriented differently with respect to the axis of the device pole. In this exercise, the device pole is suspended more horizontally than with the embodiment of FIG. 1 at the point of engagement with a surface, and the yoke and ball would be further away from the user than in the embodiment of FIG. 1. To enable the ball to engage a surface, the yoke arms are in a plane that is at an angle to the axis of the device pole, the angle being that necessary to have the yoke more or less at a vertical angle with respect to the surface at the time of engagement of the ball with the surface. In this embodiment of the present invention, the angle could be adjustable to accommodate different users. In addition, it is with in the scope of the present invention to proved an exercise device wherein the pole has a yoke and ball at both ends allowing the user to exercise in a manner similar to paddling a kayak, namely executing a stroke on one side and then on the opposite side, in an alternating manner. As with the embodiment of FIG. 1, the device pole would comprise an extension means allowing it to be shortened or extended, and would have a variable resistance means allowing the ball resistance to rolling to be controlled by the device user.

In a further option, the device of the present invention comprises a single pole that can be adapted for either a canoe paddling exercise or a kayak paddling exercise. For instance, the device can comprise an adjustable yoke wherein the angle of the yoke arms with respect to the axis of the pole can be varied depending upon the exercise being performed. Alternatively, the pole could be fitted with one yoke suitable for a canoe paddling exercise or fitted with a second yoke suitable for a kayak paddling exercise. Similarly, the single pole could be adapted for simulated kayak paddling on one side only, or could be adapted for simulated kayak paddling on both sides simply by adding an extension to the grip end of the pole that has a yoke and ball on it.

Figure 3:
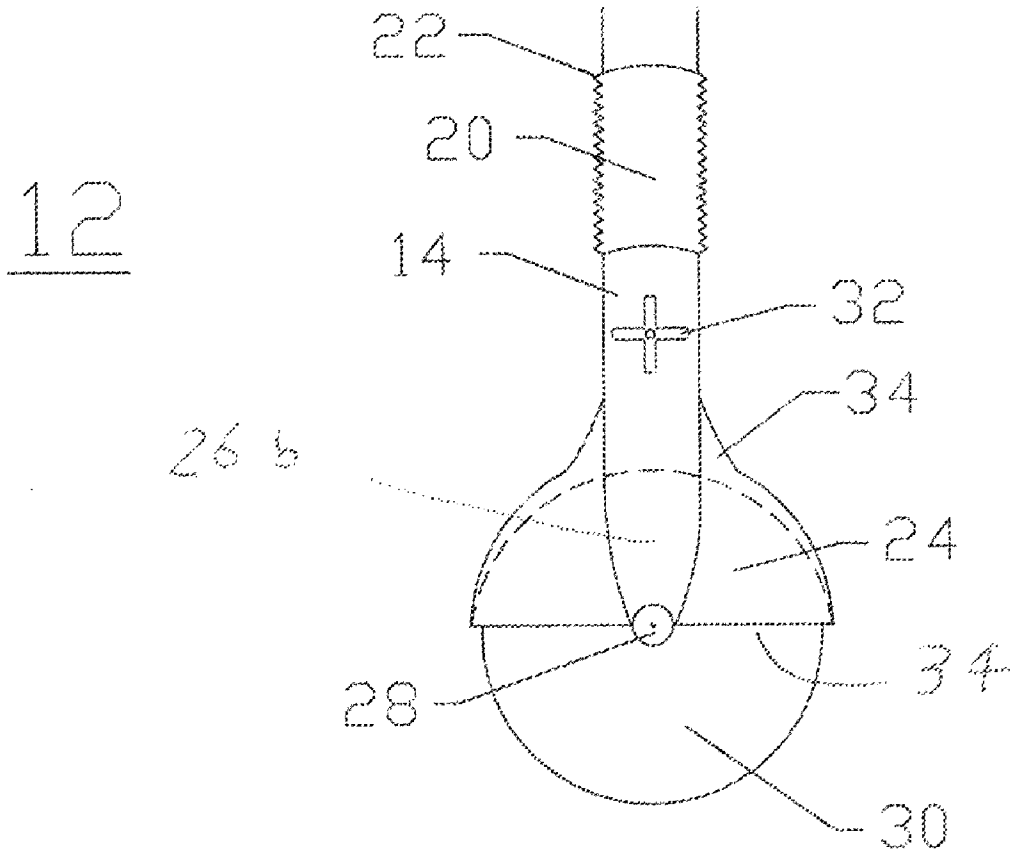
FIG. 3 is an enlarged side view of the lower end of the exercise device of FIG. 1 taken at right angles to the views of FIGS. 1 and 2.

In the embodiments of FIGS. 1 through 3, the yoke 24 comprises a dome-shaped or cup-shaped cover portion 34 (most clearly seen in FIG. 3) that is integral with the yoke arms 26*a* and 26*b* and that enhances the appearance of the exercise device 12. As an option, the cup shape of the yoke can be configured to embrace the ball 30 for more than half the ball circumference and thus hold the ball without the need for an axle. In this case the ball could move multi-directionally.

In this embodiment, the ball 30 could be held in such a way that it is movable axially with regard to the axis of the pole 14. Resistance to rotation occurs when the ball 30 is moved axially enough to engage the resistance pad 33. The resistance pad could be affixed to the inside the cup 34. The cup 34 could be spring attached to the pole 14 so that downward thrust by the user against a surface and axial movement of the ball 30 against the pad compresses the spring. Increased compression of the spring by increased user thrust increases the resistance to rotation of the ball 30. In this embodiment, the spring could function to absorb shock as well as increase the resistance to rotation of the ball, thus supplementing or replacing shock absorption means 20.

A principle advantage of the present invention is that it provides an exercise device that is lightweight and easy to transport. It is a device that can be used in gyms, or at home or in an office. It can be used by personal trainers or physical therapists to improve neuromuscular/proprioceptive coordination, balance and core strength. The device can be used while standing regularly with both legs on the ground with knees slightly bent, or while standing on one leg, or in a lunge, walking lunge or semi-squat position (thereby moving the center of gravity in the paddling motion, for example—a walking lunge with paddle stroke—versus—just doing a walking lunge). It can also be used while sitting on an exercise ball, or a chair, with one or both legs on the ground. The device can also be used while sitting on the floor with knees up and legs bent at a 90 degree position, with feet on the floor or elevated.

It is also possible to use the device to perform shoulder strengthening exercises, where the arm is bent 90 degrees at the elbow and moves towards or away from the body with the hand facing in.

The device can be used aerobically, and it can be used to improve balance and core strength while also improving strength and endurance of arms, chest, shoulders and back. The device is also useful at home by individuals, by trainers (wanting to add variety and challenge to exercise routines), or in a class setting—for balance and core strength improvement—that carries into improvement in movement in everyday life.

The composition and size of the ball 30 are not critical. A ball slightly larger than a tennis ball can be used. It should be lightweight. A rubber composition provides good gripping with most surfaces and is durable. If desired, the exercise device of the present invention can be marketed with a mat and ball having a special composition to roll on rather than slide on the mat. To be lightweight, it may be desirable to make the pole of aluminum, plastic, or other such light weight material.

The exercise device of the present invention can be provided with other enhancements; for instance, a calorie and/or stroke counter that lets a person using the device know how he or she is doing, or a timer, and the like. The device could also have electronic components coupling it with a video display simulating or illustrating various paddling workouts that can be used.

From the above description of the present invention, those skilled in the art will perceive improvements, modifications and changes. Such improvements, modifications and changes within the skill of the art are intended to be covered by the appended claims.

What is claimed is:

1. An exercise device comprising;

an elongated single pole having the configuration of a canoe paddle stem that can be grasped in two hands;

a rotatable circular means;

an axle secured at one end of said pole, said circular means being rotatable on said axle;

an adjustable resistance means at said one end providing an adjustable resistance to rotation of said rotatable circular means;

control means adapted to set the resistance of said adjustable resistance means so that said resistance remains at whatever point is set by the user of the device; and a palm sized grip at the end of the pole opposite said one end, said grip being centered on the axis of the pole and having a longitudinal dimension configured to lie generally in a plane that is aligned with the plane of said axle, said grip enabling a user of the device to grab the grip in one hand and to orient the rotational angle of the pole.

2. The exercise device of claim 1 further including a yoke at said one end of said pole, the yoke comprising spaced apart arms and said axle extending between said arms.

3. The device of claim 1 wherein said resistance means comprises a resistance pad bearing against the surface of said circular means.

4. The device of claim 3 wherein said control means comprises a control knob mounted on said pole adapted to control the force of said resistance pad against the surface of the circular means.

5. The device of claim 1 wherein said pole further includes shock absorption means for absorbing shock when said circular means is brought into engagement with a surface.

6. The device of claim 5 wherein said shock absorption means is adjustable to vary the amount of shock absorption.

7. The device of claim 1 wherein said circular means is a ball.

8. The device of claim 1 wherein said circular means is a wheel.

9. The device of claim 1 wherein said resistance means is a variable resistance brake.

10. The device of claim 1 further including extension means for shortening or lengthening said pole.

11. An exercise device comprising:

an elongated single pole having the configuration of a canoe paddle stem that can be grasped in two hands;

a rotatable circular means at one end of said pole, said circular means having an axis of rotation;

an adjustable resistance means at said one end providing an adjustable resistance to rotation of said rotatable circular means;

control means adapted to set the resistance of said adjustable resistance means so that said resistance remains at whatever point is set by the user of the device; and a palm sized grip at the end of the pole opposite said one end, said grip being centered on the axis of the pole and having a longitudinal dimension configured to lie generally in a plane that is aligned with the plane of said axis, said grip enabling a user of the device to grab the grip in one hand and to orient the rotational angle of the pole.

* * * * *